US006923283B2

(12) United States Patent
Beito

(10) Patent No.: US 6,923,283 B2
(45) Date of Patent: Aug. 2, 2005

(54) GROOVED OIL PAN FOR USE WITH A SNOWMOBILE

(75) Inventor: David E. Beito, Thief River Falls, MN (US)

(73) Assignee: Arctic Cat Inc., Thief River Falls, MN (US)

( * ) Notice: Subject to any disclaimer, the term of this patent is extended or adjusted under 35 U.S.C. 154(b) by 403 days.

(21) Appl. No.: 10/122,430

(22) Filed: Apr. 11, 2002

(65) Prior Publication Data

US 2004/0163892 A1 Aug. 26, 2004

(51) Int. Cl.[7] ..... B62M 27/02
(52) U.S. Cl. ..... 180/190; 123/196 R; 123/195 C
(58) Field of Search ..... 123/196 R, 195 C; 180/190

(56) References Cited

U.S. PATENT DOCUMENTS 4,452,194 A * 6/1984 Watanabe ..... 123/195 P
5,373,892 A * 12/1994 Johnson et al. ..... 165/41
5,526,781 A * 6/1996 Sugiyama et al. ..... 123/195 C
5,529,313 A * 6/1996 Malks ..... 277/598
6,454,037 B1 * 9/2002 Atsuumi et al. ..... 180/190
6,526,934 B1 * 3/2003 Lagies ..... 123/195 C
6,547,021 B1 * 4/2003 Kai et al. ..... 180/190

* cited by examiner

*Primary Examiner*—Andrew M. Dolinar
*Assistant Examiner*—Katrina B. Harris
(74) *Attorney, Agent, or Firm*—Merchant & Gould P.C.

(57) ABSTRACT

Herein is disclosed a snowmobile with an improved center of gravity. The snowmobile utilizes an oil pan with a bottom portion and a set of side portions that cooperate with the bottom portion to form a sump in which oil collects. The bottom portion may be grooved to permit a steering shaft to pass through the groove, thereby extending from one side of the oil pan to the other side. Optionally the bottom portion is formed to be congruous with a surface of a mechanism, such as a steering shaft, positioned at least partially beneath the oil pan. Furthermore, the oil pan may have a reduced depth.

17 Claims, 7 Drawing Sheets

GROOVED OIL PAN FOR USE WITH A SNOWMOBILE

FIELD OF THE INVENTION

The invention relates generally to personal recreational vehicles, and more particularly to an improved oil pan for use with engines that power snowmobiles.

BACKGROUND OF THE INVENTION

In the past, personal recreational vehicles, such as snowmobiles, were powered by two-stroke engines. Two-stroke engines had been favored because of their relative simplicity, inexpensiveness, reliable cold weather starting ability, and high power-to-weight ratio. Use of two-stroke engines had drawbacks, however. Because two-stroke engines combust a fuel-oil mixture (oil is mixed with fuel for the sake of engine lubrication), they are less efficient and generate undesirable emissions. Such emissions are environmentally hazardous, unsightly, and acrid. Due to environmental considerations, manufacturers of snowmobiles are beginning to migrate away from two-stroke engines, using four-stroke engines, instead.

Four-stroke engines do not utilize a fuel-oil mixture. Rather, four-stroke engines combust unmixed fuel. With regard to engine lubrication, four-stroke engines make use of a separate oiling system with an oil pan located at the bottom of the engine. The oil pan forms a sump or reservoir in which oil used for lubricating the engine is collected or housed. An oil pump forces the oil from the oil pan through the internal mechanisms of the engine. Under the force of gravity, the oil drains back to the oil pan, whereupon it is again pumped throughout the engine.

Regardless of whether two-stroke or four-stroke engines were used, snowmobile manufacturers have sought to enhance the maneuverability and stability of the snowmobile. Maneuverability and stability are, in part, functions of the center of gravity of the snowmobile; the lower the center of gravity of the snowmobile, the greater the stability and maneuverability of the vehicle. The center of gravity of a snowmobile is greatly influenced by the placement of its engine. As the engine is mounted lower within the chassis, the center of gravity of the vehicle moves nearer to the ground. Thus, it is desirable to mount the engine as low as is possible (while still leaving minimally sufficient room for ground clearance).

One factor that frustrates the effort to mount a four-stroke engine at a relatively low point within its chassis is that the oil pan, which sits at the bottom of the engine, must make room for a steering shaft (or other form of stearing linkage). The steering linkage runs from the handlebars to a point beneath the engine, where tie-rods connect the steering shaft to the front skis. Accordingly, in the prior art, it has been necessary to mount the engine such that it is located above a segment of the steering linkage proximal to the tie-rods. As a result, the segment of the steering linkage proximal to the tie-rods has served as a boundary beneath which the engine could not be mounted (because the bottom surface of the engine would physically collide with the steering shaft).

For the aforestated reasons, it is desirable to devise a means by which an engine may be mounted at a low point in a chassis, yet still provide room for positioning of the steering shaft.

SUMMARY OF THE INVENTION

Against this backdrop, the invention has been created. One embodiment of the invention includes an oil pan with a bottom portion and a set of side portions that cooperate with the bottom portion to form a sump in which oil collects. The bottom portion is formed to be congruous with a surface of a mechanism, such as a steering shaft, positioned at least partially beneath the oil pan.

According to another embodiment of the invention, the bottom portion is grooved to permit a steering shaft to pass through the groove, thereby extending from one side of the oil pan to the other side.

According to yet another embodiment of the invention, the oil pan is characterized by a depth. The depth of the oil pan is no more than 140 millimeters (±15%).

According to yet another embodiment of the invention, a personal recreational vehicle, such as a snowmobile, includes an engine mounted upon a frame. An oil pan is attached toward the bottom of the engine. A steering shaft runs between a steering mechanism and a point beneath the engine, proximal to the front skis, thereby running at least partially beneath the oil pan. The oil pan possesses a bottom portion that is grooved so as to permit a shaft to pass through the groove, thereby passing from a first side of the oil pan to a second side of the oil pan.

DETAILED DESCRIPTION OF THE INVENTION

Figure 1:
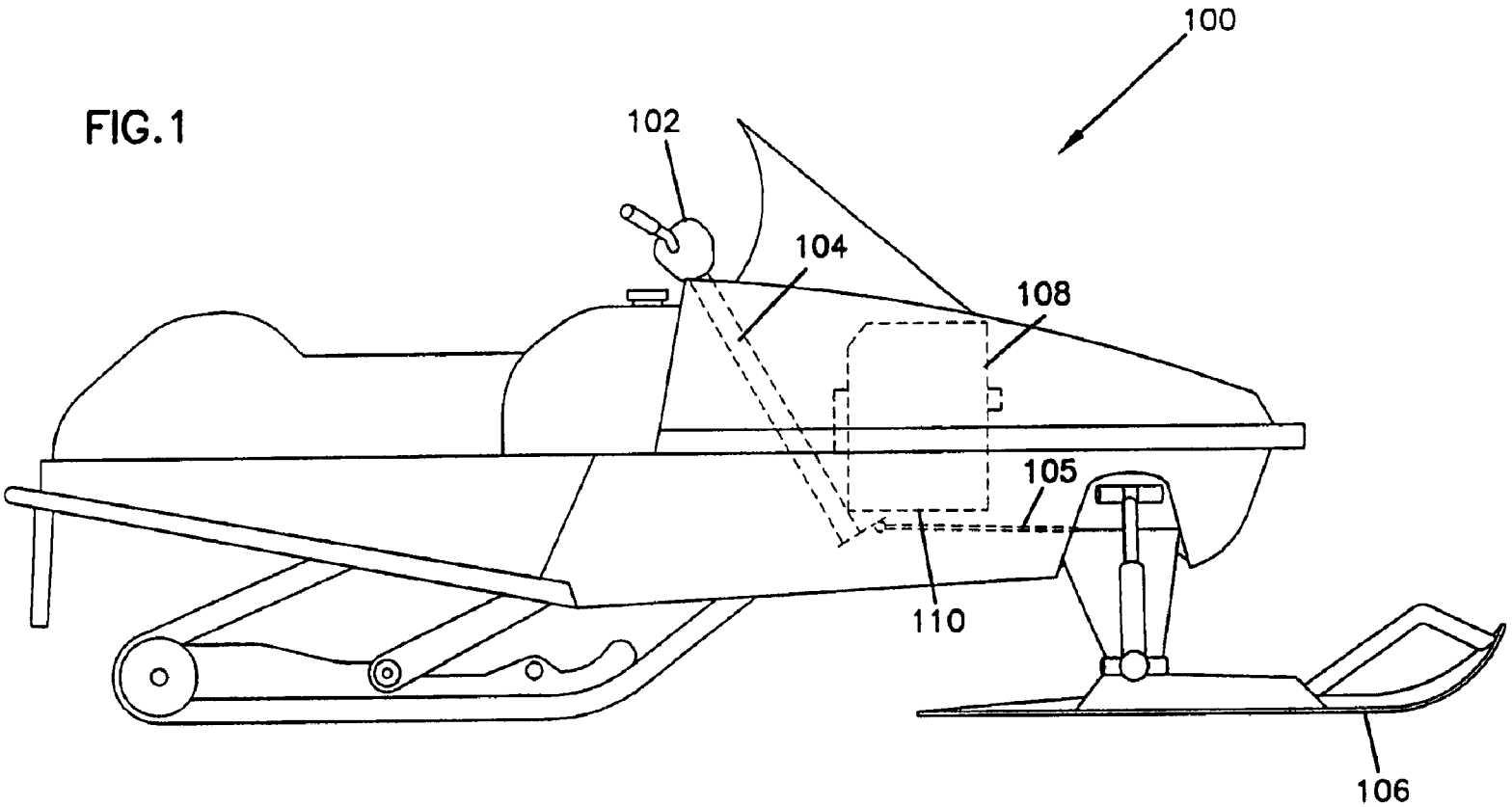
PRIOR ART FIG. 1
FIG. 1 depicts a snowmobile known in the prior art.

FIG. 1 depicts a snowmobile 100 with a steering mechanism 102 that controls the orientation of a set of front skis 106 via a steering shaft 104. The steering shaft 104 couples the steering mechanism 102 with the front skis 106 via a drag link 105, which runs along the bottom surface of the engine 108. The drag link 105 is, in turn, coupled to the front skis 106 via a bell crank (not shown) and a set of tie rods (not shown). As the steering mechanism 102 is turned, the front skis 106 also turn, thereby controlling the direction in which the snowmobile 100 moves. The linkages connecting the steering mechanism 102 to the front skis 106 are referred to generally as "steering linkages." For example, the steering shaft 104 and the drag link 105 are steering linkages. The details regarding coupling of the steering linkages and the front skis 106 vary from snowmobile to snowmobile and are outside the scope of the present invention.

An engine 108 is mounted toward the front of the chassis of the snowmobile 100. The engine provides power to the drive train (not shown) of the snowmobile 100. The details of the drive train vary from snowmobile to snowmobile and are outside of the scope of this invention. Mounted toward the bottom of the engine 108 is an oil pan 110. The oil pan 110 forms a sump or reservoir in which oil used for lubricating the engine 108 is collected or housed. An oil pump (not shown) pumps the oil from the oil pan 110 through the internal mechanisms of the engine 108. Under the force of gravity, the oil drains back to the oil pan 110, whereupon it is again pumped throughout the engine 108.

As can be seen from FIG. 1, the steering linkages (such as the steering shaft 104 and the drag link 105) serve as an obstacle around which the engine 108 and oil pan 110 must be mounted. For the sake of maneuverability and stability, it is desirable for the engine 108 and oil pan 110 to be mounted at a low point in the chassis. Such a mounting scheme lowers the center of gravity of the snowmobile 100. Additionally, it is desirable for the engine 108 and oil pan 110 to be mounted near the operator of the snowmobile 100, so that the center of gravity of the snowmobile 100 is moved closer to the operator. Unfortunately, as can be seen from FIG. 1, the steering linkages have heretofore forced the engine 108 and oil pan 110 to be mounted at a point in the chassis sufficiently high to permit the steering shaft 104 and/or the drag link 105 to run toward the front skis 106. Neither the engine 108 nor the oil pan 110 depicted in FIG. 1 are particularly near the operator or the ground.

Figure 2:
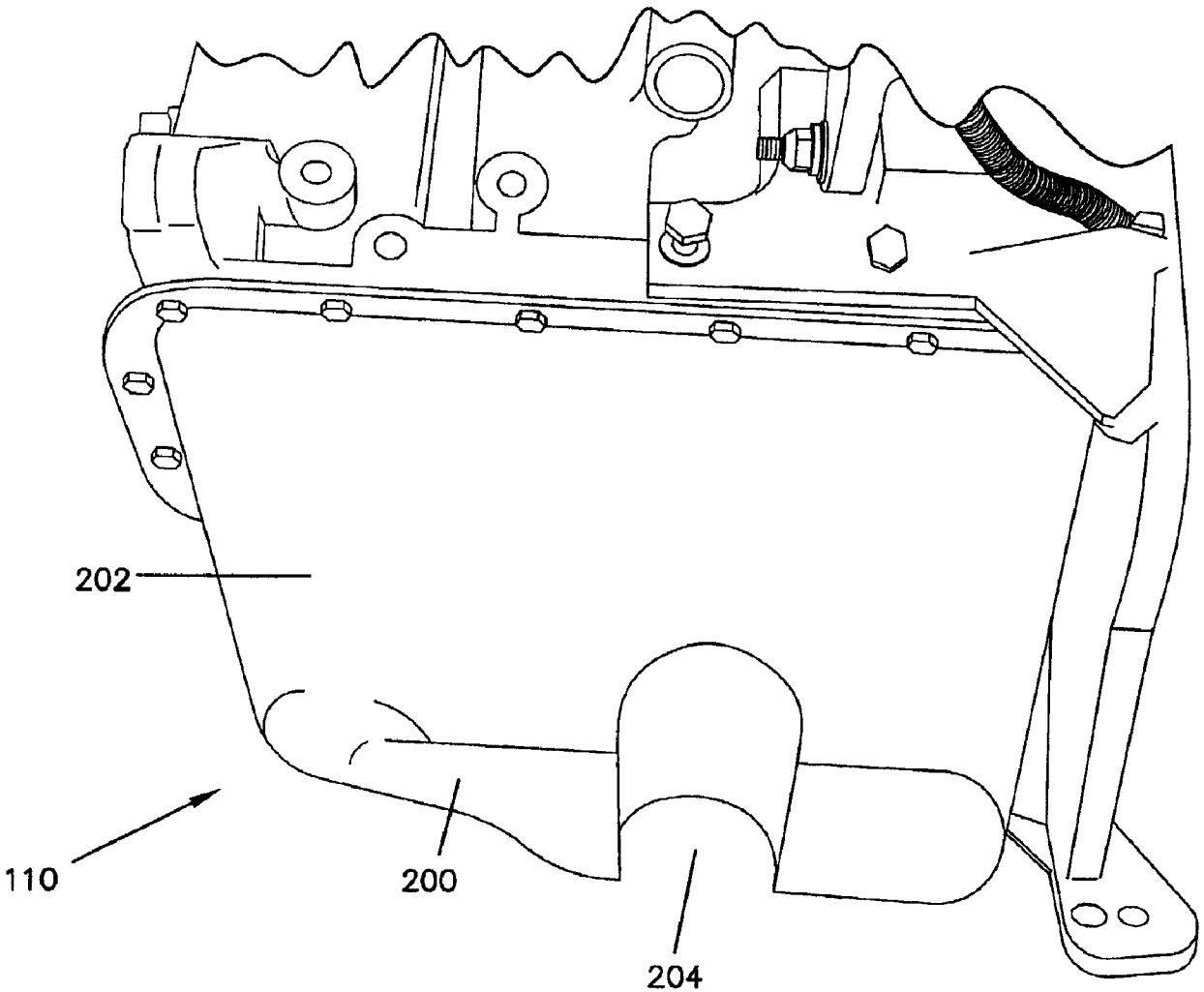
FIG. 2 depicts one embodiment of an oil pan, in accordance with one embodiment of the present invention.

FIG. 2 depicts one embodiment of an oil pan 110 in accordance with the present invention. The oil pan 110 has a bottom portion 200 and side portions 202 that cooperate to form a sump in which oil may collect. As can be seen from FIG. 2, the side portions 202 and the bottom portion 200 form a passage or groove 204. A steering linkage, such as the steering shaft 104 or the drag link 105, may run through the passage 204, thereby extending from one side of the oil pan 110 to the other side of the oil pan 110. The passage 204 may be congruous with a surface of the steering linkage running through the passage. For example, as shown in FIG. 2, the passage 204 is semicyclindrical and is therefore congruous with a portion of the surface of the cylindrical drag link 105.

Figure 3:
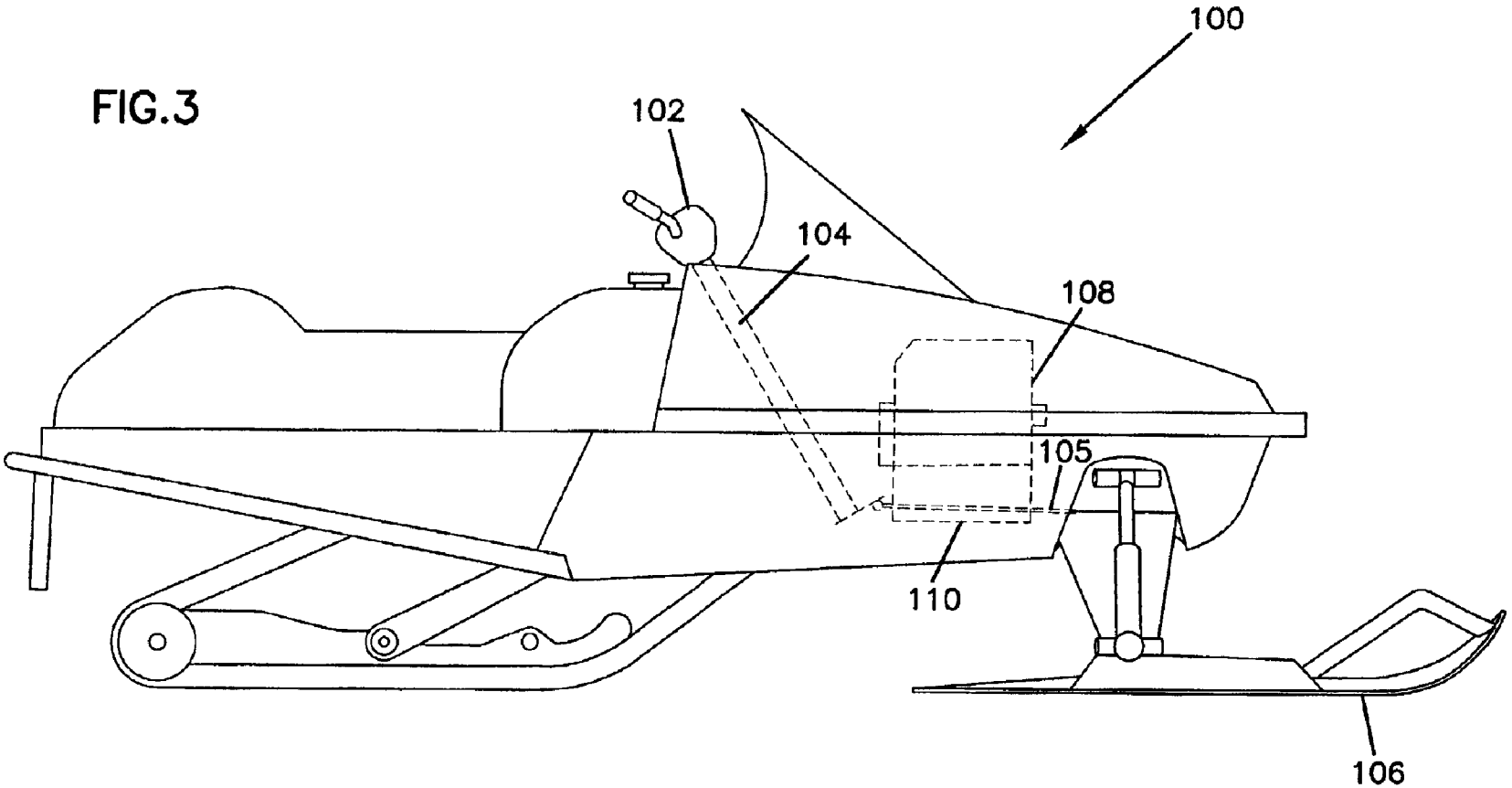
FIG. 3 depicts a snowmobile with a steering linkage passing through a grooved oil pan.

The oil pan 110 of FIG. 2 permits the engine 108 and oil pan 110 to be mounted at a relatively low point in the chassis of the snowmobile 100, as shown in FIG. 3. As is illustrated in FIG. 3, the engine 108 sits upright, while the drag link 105 passes through the passage 204 formed in the oil pan 110. Because the oil pan 110 of FIGS. 2 and 3 does not need to be mounted with its bottom surface entirely atop the drag link 105 (as was necessary in the prior art), the engine 108 and oil pan 110 may be mounted at a relatively low point in the chassis, with a portion of the oil pan 110 partially enveloping the drag link 105.

Figure 4:
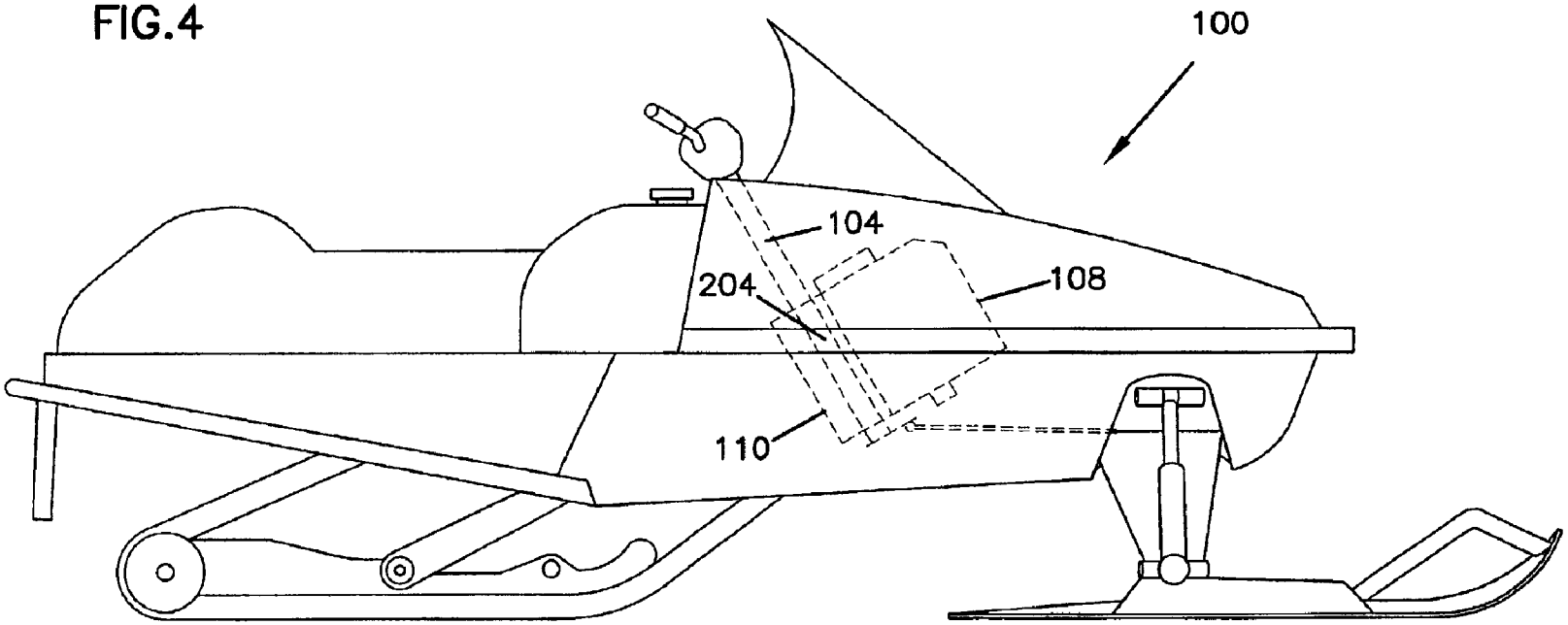
FIG. 4 depicts a snowmobile with a steering shaft passing through a grooved oil pan.

Alternatively, as shown in FIG. 4, the engine 108 may be mounted at an angle, so as to permit the steering shaft 104 to pass through the groove 204 formed in the oil pan. Because the oil pan 110 does not need to be mounted with its bottom surface entirely atop the steering shaft 104, the engine 108 and oil pan 110 may be mounted at a relatively low point in the chassis, with a portion of the oil pan 110 partially enveloping the steering shaft 104.

Figure 5:
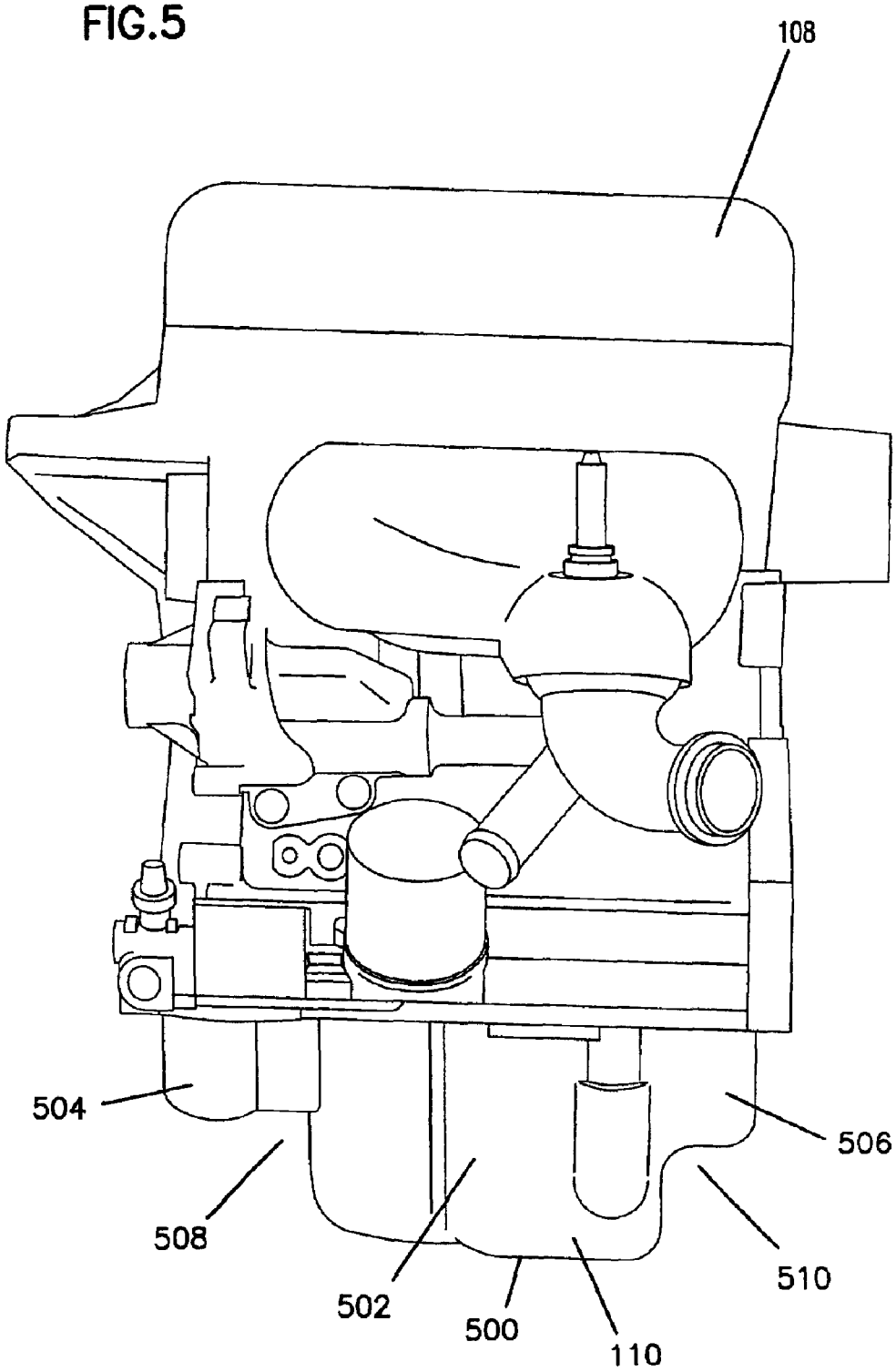
FIG. 5 depicts an alternate embodiment of the oil pan, in accordance one embodiment of the present invention.

FIG. 5 depicts an alternate embodiment of the oil pan 110, in accordance with the present invention. Similar to the embodiment of the oil pan 110 depicted in FIG. 2, the oil pan 110 of FIG. 5 possesses a bottom surface 500. Side portions 502 cooperate with the bottom surface 500 to form a sump, which acts as a collector or reservior for oil. As can be seen from FIG. 5, the oil pan 110 possesses a first flange 504 and a second flange 506. Beneath the first flange 504 is a first passage 508. Rather than being centrally located, the first passage 508 is formed at the periphery of the oil pan 110, thereby defining the first flange 504. A steering linkage may pass through the first passage 508. Beneath the second flange 506 is a second passage 510. A second mechansim or structure, such as a bulkhead (not depicted) may pass through the space defined by the second passage 510.

Although the embodiment of FIG. 5 depicts an oil pan 110 having two passages 508 and 510, the oil pan 110 may contain any number of passages. Additionally, the oil pan 110 may contain a combination of centrally-located and peripheral passages.

Figure 6:
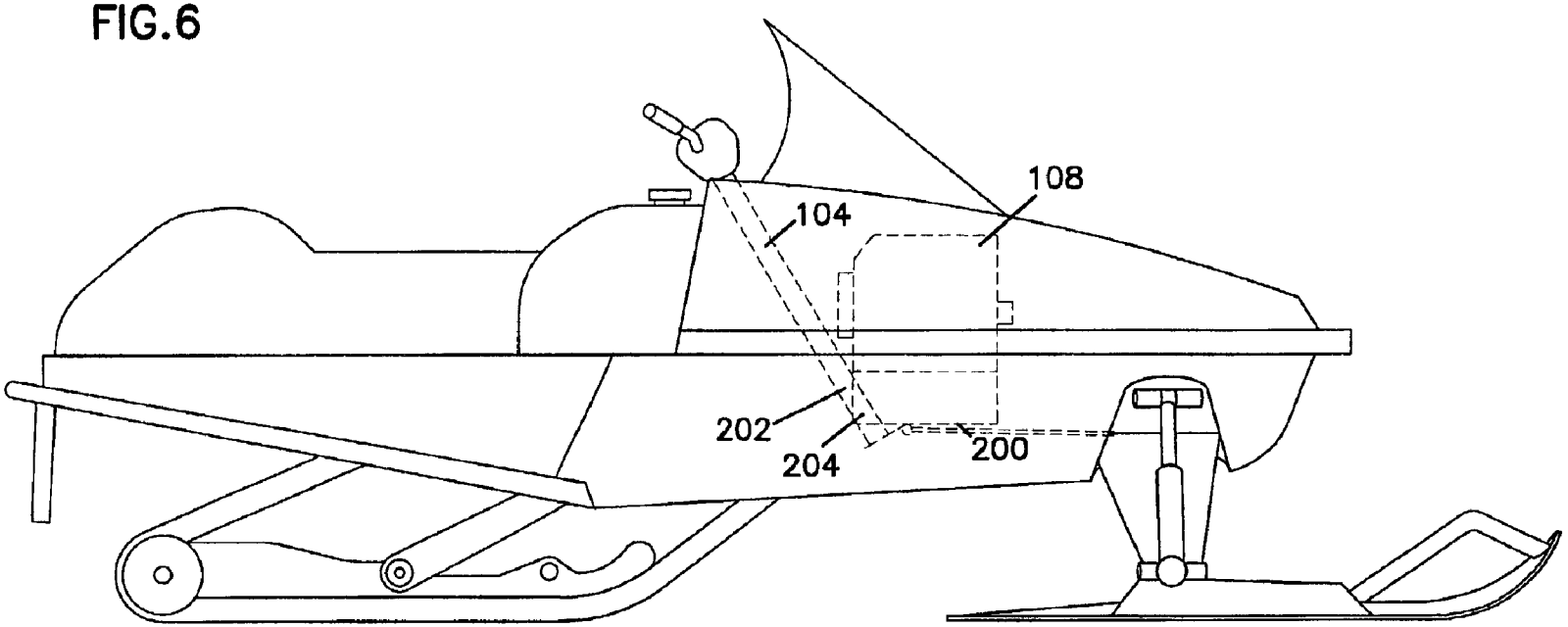
FIG. 6 depicts another embodiment of the oil pan, in accordance with one embodiment of the present invention.

FIG. 6 depicts another embodiment of the oil pan, in accordance with the present invention. As shown in FIG. 6, the passage 204 may be angled so as to run through a single side wall 202 and a section of the bottom portion 200 (as opposed to running through two side walls 202 and extending the full length of the bottom portion 200, as shown in FIG. 2). This embodiment is another way of permitting the engine 108 to be mounted upright, because the passage 204 itself is created at an angle, permitting the steering shaft 104 to run through the passage 204 without having to angle the engine 108.

Figure 7:
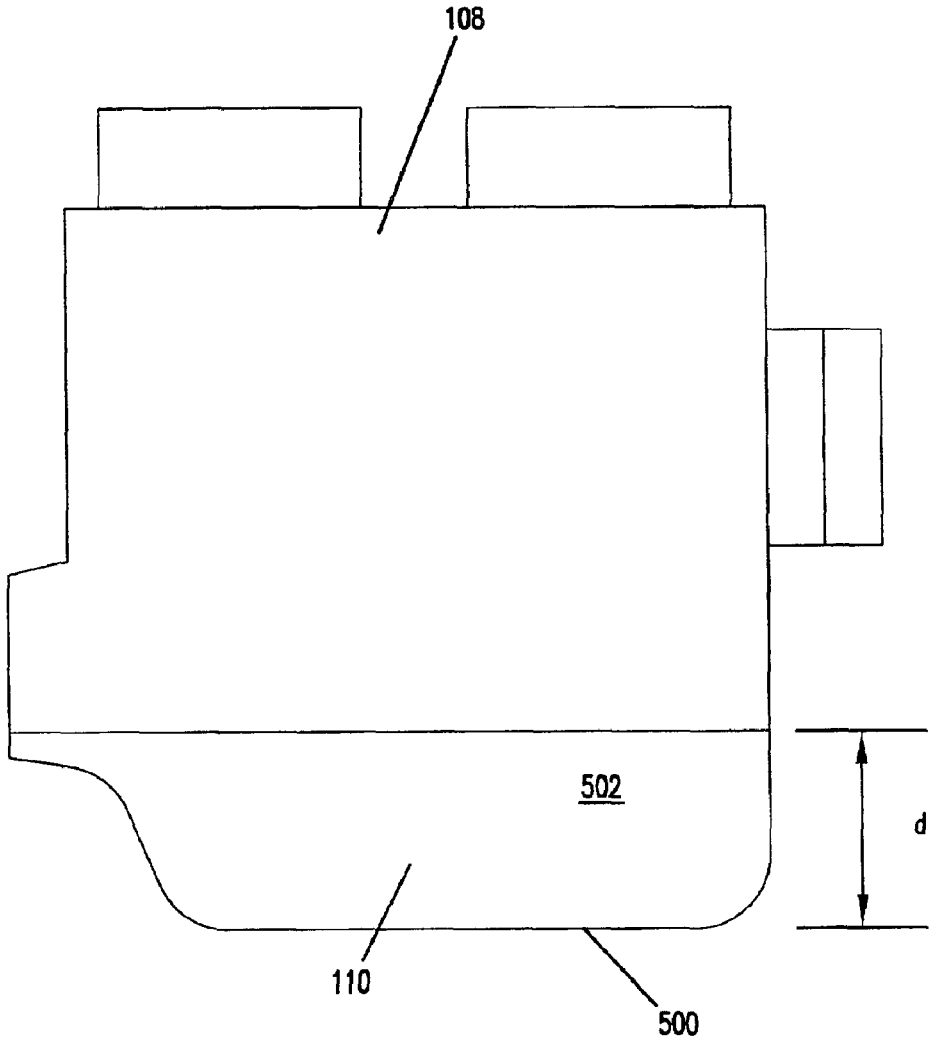
FIG. 7 depicts an oil pan with a reduced depth, in accordance with one embodiment of the present invention.

FIG. 7 depicts yet another embodiment of an oil pan 110 in accordance with the present invention. The oil pan 110 of FIG. 5 has a bottom portion 500 that cooperates with side portions 502 to form a sump in which oil collects for circulation through the engine 108. The oil pan is characterized by a depth, d, as shown in FIG. 5. The depth, d, of the oil pan 110 in the embodiment of FIG. 5 is reduced in comparison to the oil pan depicted in FIG. 1. Be reducing the depth, d, of the oil pan 110, the engine 108 may be mounted at a point lower in the chassis, thereby lowering the center of gravity of the snowmobile 100. The depth, d, of the oil pan may be no more than 140 millimeters. Preferably, the depth, d, is no more than 123.2 millimeters (mm.). The reduction in oil pan depth, d, can be quantified by comparing the depth, d, of the oil pan to the volume of the sump. According to one embodiment of the invention, this ratio is less than 140 mm./3 quarts of oil, and is preferably less than 123.2 mm./3 quarts of oil.

The embodiments depicted in FIGS. 2–7, although presented individually, may be combined to form an oil pan with features from more than one the embodiments presented therein. For example, an oil pan may have a centrally located passage and a periperally-located passage. Additionally, an oil pan may have a passage running through a single side wall (as shown in FIG. 6) in addition of a passage running through a set of side walls. Further, an oil pan may have a reduced depth and a passage defined by its bottom and/or side portions.

It will be clear that the present invention is well adapted to attain the ends and advantages mentioned as well as those inherent therein. While presently preferred embodiments have been described for purposes of this disclosure, various changes and modifications may be made which are well within the scope of the present invention. For example, the groove in the oil pan may be formed in a different shape, and may be formed to accommodate another mechanism in lieu of, or in addition to, a steering shaft. Additionally, the depth of the oil pan may be made to be irregular. Numerous other changes may be made which will readily suggest themselves to those skilled in the art and which are encompassed in the spirit of the invention disclosed and as defined in the appended claims.

The claimed invention is:

1. An oil pan for a snowmobile, the oil pan comprising:

a bottom portion; and a set of side portions that cooperate with the bottom portion to form a sump in which oil may collect;

wherein the bottom portion is formed to be congruous with at least a portion of a surface of a mechanism positioned at least partially beneath the bottom portion and between the side portions of the oil pan.

2. The oil pan of claim 1, wherein the bottom portion is formed to be congruous with at least a portion of a surface of a steering linkage.

3. The oil pan of claim 1, wherein at least one of the side portions is formed to be congruous with at least a portion of a surface of a mechanism positioned at least partially along the at least one side portion.

4. The oil pan of claim 3, wherein the bottom portion and at least one side portion are formed to be congruous with at least a portion of a surface of a steering linkage passing from a first side of the oil pan to a second side of the oil pan.

5. An improved oil pan for a personal recreational vehicle, the improved oil pan comprising:

a bottom portion; and a set of side portions that cooperate with the bottom portion to form a sump in which oil may collect;

wherein the bottom portion is grooved so as to permit a steering linkage to pass through the groove, thereby passing from a first side of the oil pan to a second side of the oil pan.

6. The oil pan of claim 5, wherein at least one of the side portions is grooved so as to permit a shaft to pass through the grooved side and bottom portions, thereby passing from a first side of the oil pan to a second side of the oil pan.

7. An improved oil pan for a personal recreational vehicle, the improved oil pan comprising:

a bottom portion; and a set of side portions that cooperate with the bottom portion to form a sump in which oil may collect;

wherein the bottom portion defines a groove, the groove being configured to permit a steering linkage to pass within the groove;

wherein the oil pan is characterized by a depth, the depth of the oil pan being defined as the distance that the side portions project from the bottom portion, as measured against a vector that is perpendicular to the bottom portion; and wherein the depth of the oil pan no more than 140 millimeters.

8. The oil pan of claim 7, wherein the depth of the oil pan is no more than 123.2 millimeters.

9. The oil pan of claim 7, wherein the sump is characterized by a volume; and wherein the ratio of the height of the oil pan to the volume of the sump is no more than 140 millimeters per 3 quarts.

10. The oil pan of claim 9, wherein the ratio of the height of the oil pan to the volume of the sump is no more than 123.2 millimeters per 3 quarts.

11. The oil pan of claim 7, wherein the bottom portion defines more than one groove.

12. A snowmobile vehicle comprising:

an engine mounted upon a frame of the snowmobile;

an oil pan connected to a bottom portion of the engine, the oil pan including a bottom portion that defines a groove that extends from a first side to a second side of the oil pan; and a steering shaft, at least a portion of which runs beneath the oil pan and within the groove.

13. The snowmobile of claim 12, wherein:

the oil pan is characterized by a depth and a volume; and wherein the ratio of the depth of the oil pan to the volume of the oil pan is no more than 140 millimeters per 3 quarts.

14. The snowmobile of claim 13, wherein the ratio of the depth of the oil pan to the volume of the oil pan is no more than 123.2 millimeters per 3 quarts.

15. The snowmobile of claim 12, wherein the oil pan includes a side portion that defines a groove, the side portion groove being configured to permit a shaft of the snowmobile to pass beneath the oil pan.

16. The snowmobile of claim 12, wherein the bottom portion defines at least two grooves that extend between the first and second sides of the oil pan.

17. The snowmobile of claim 12, wherein:

the bottom portion of the oil pan is bounded by a periphery; and the groove runs along a portion of the periphery, thereby forming a flange above the groove.

* * * * *